US005246168A

United States Patent [19]

Williams

[11] Patent Number: 5,246,168

[45] Date of Patent: Sep. 21, 1993

[54] LIQUID ADDITIVES DISPENSER FOR SPRINKLER SYSTEMS

[76] Inventor: Richard Williams, 2538 Westford Way, Mountain View, Calif. 94040

[21] Appl. No.: 802,602

[22] Filed: Dec. 5, 1991

[51] Int. Cl.[5] ..... B05B 7/32

[52] U.S. Cl. ..... 239/313; 239/320; 222/129.2; 137/564.5; 137/897; 137/239

[58] Field of Search ..... 239/310, 313, 316, 320; 137/564.5, 897, 895, 239; 222/129.2

[56] References Cited

U.S. PATENT DOCUMENTS

| | | | |
|---|---|---|---|
| 1,205,513 | 11/1916 | Carlson | 137/564.5 |
| 1,241,551 | 10/1917 | Priser | 137/564.5 |
| 1,347,520 | 7/1920 | Rasch | 239/313 |
| 1,473,025 | 11/1923 | Erickson | 239/313 |
| 1,736,803 | 11/1929 | Shields et al. | 239/313 |
| 2,034,867 | 3/1936 | Hayes | 239/313 |
| 2,323,618 | 7/1943 | Ottoson | 299/85 |
| 2,563,211 | 8/1951 | Cassese | 137/564.5 |
| 2,574,756 | 11/1951 | Petsch | 137/564.5 |
| 2,789,010 | 4/1957 | Dean | 299/84 |
| 3,200,840 | 8/1965 | Watts | 137/564.5 |
| 3,391,829 | 7/1968 | Gregory | 239/313 |
| 4,047,541 | 9/1977 | Mercier et al. | 239/313 |
| 4,406,406 | 9/1983 | Knapp | 239/313 |
| 4,545,535 | 10/1985 | Knapp . | |
| 4,750,522 | 6/1988 | Griffin et al. | 137/895 |
| 4,846,214 | 7/1989 | Strong . | |
| 4,875,626 | 10/1989 | Buhler et al. . | |
| 4,886,212 | 12/1989 | Proctor et al. | 137/564.5 |
| 5,088,517 | 2/1992 | Bersch | 137/564.5 |

FOREIGN PATENT DOCUMENTS

| | | | |
|---|---|---|---|
| 15458 | of 1913 | United Kingdom | 239/310 |

*Primary Examiner*—Andres Kashnikow
*Assistant Examiner*—Lesley D. Morris
*Attorney, Agent, or Firm*—Paul F. Schenck

[57] ABSTRACT

A flow controlled dispenser adds liquid additives at a rate proportional to the flow of the liquid receiving the additives.

4 Claims, 8 Drawing Sheets

FIG. 4b
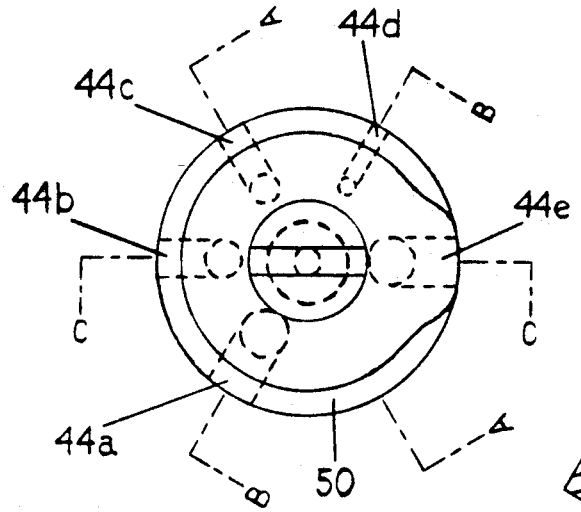
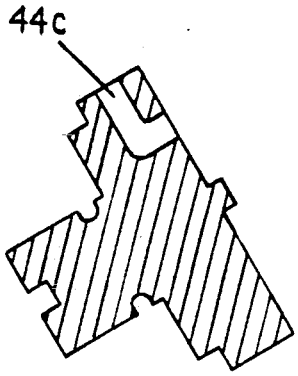
FIG. 4ba
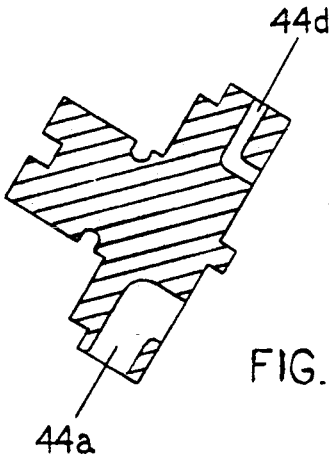
FIG. 4bb
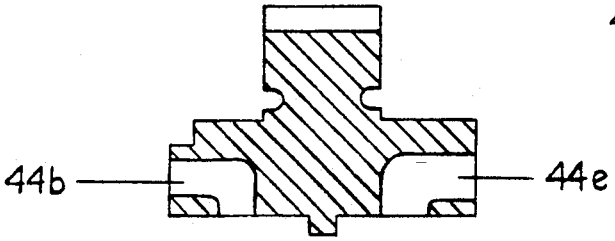
FIG. 4bc

LIQUID ADDITIVES DISPENSER FOR SPRINKLER SYSTEMS

BACKGROUND OF THE INVENTION

Fertilizing a lawn or an arrangement of bushes or flowers requires the proper distribution of the fertilizer over the area of the garden or lawn. For an even distribution, liquid fertilizers and additives have become more and more popular over the use of granular means. However, the distribution devices and especially the dispenser for liquid additives do not fulfill all requirements for a general purpose application of a common house owner. There are jars attached to a special nozzle at the end of a garden hose, and jars with injectors installed in the piping of sprinkler systems. The rate at which the additive or fertilizer is added to the water flow depends on the method used to displace the additive from the jar. Many of the dispensing devices provide a passage between an intake port of the jar and an output port of the jar. The pressure difference between both these ports generated by the water flow through that passage, causes the additive to be drawn from the jar. Depending upon the replacing medium the jar is filled with air or the additive is thinned with water. In the latter case there is no possibility to quantify the amount of additive to the throughput of water.

FIELD OF THE INVENTION

The present invention uses a new method for displacing the additive from the dispenser without thinning the additive in the dispenser and without needing a pressure difference between the intake port of the dispenser and the output port of the same. The dispenser of the present invention includes a refill port which functions as an anti-syphon valve.

SHORT DESCRIPTION OF THE INVENTION

The liquid additive dispenser of the present invention is a displacement dispenser using a free floating piston to separate additives from displacing liquids. Instead of using a pressure difference between an intake port and an output port which draws additives from the dispenser and replaces the amount of removed additives by other liquids or air, this dispenser collects displacement water from the unrestricted water flow and releases additives into the water flow accordingly. The rate at which the displacement water is collected depends on the speed of the water rushing through the water pipe to which the dispenser is connected. This principle provides for an unrestricted water flow which is controlled only by the supply valve of the installation and the sprinklers or other dispersement means connected to it.

SHORT DESCRIPTION OF THE DRAWINGS

Figure 3A:
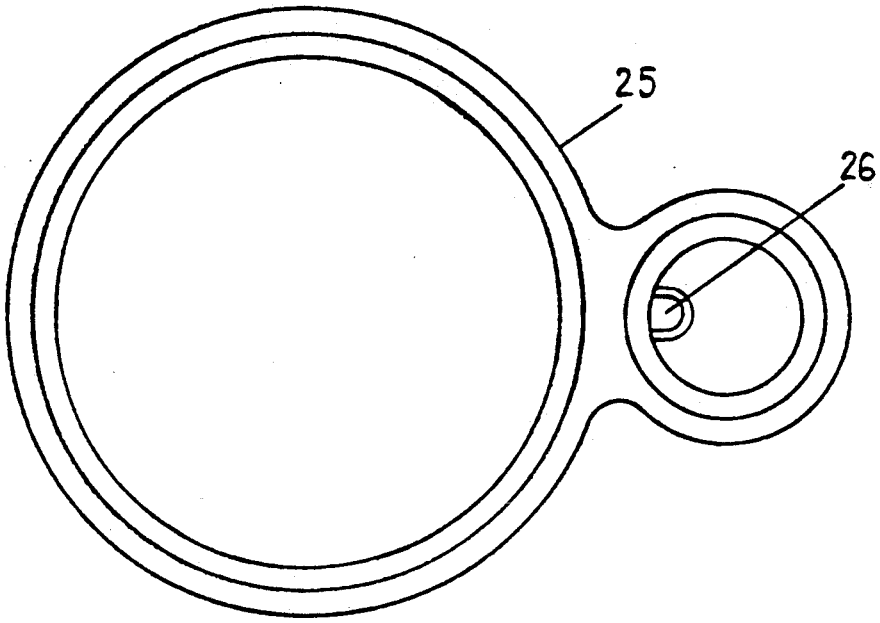
Figure 3B:
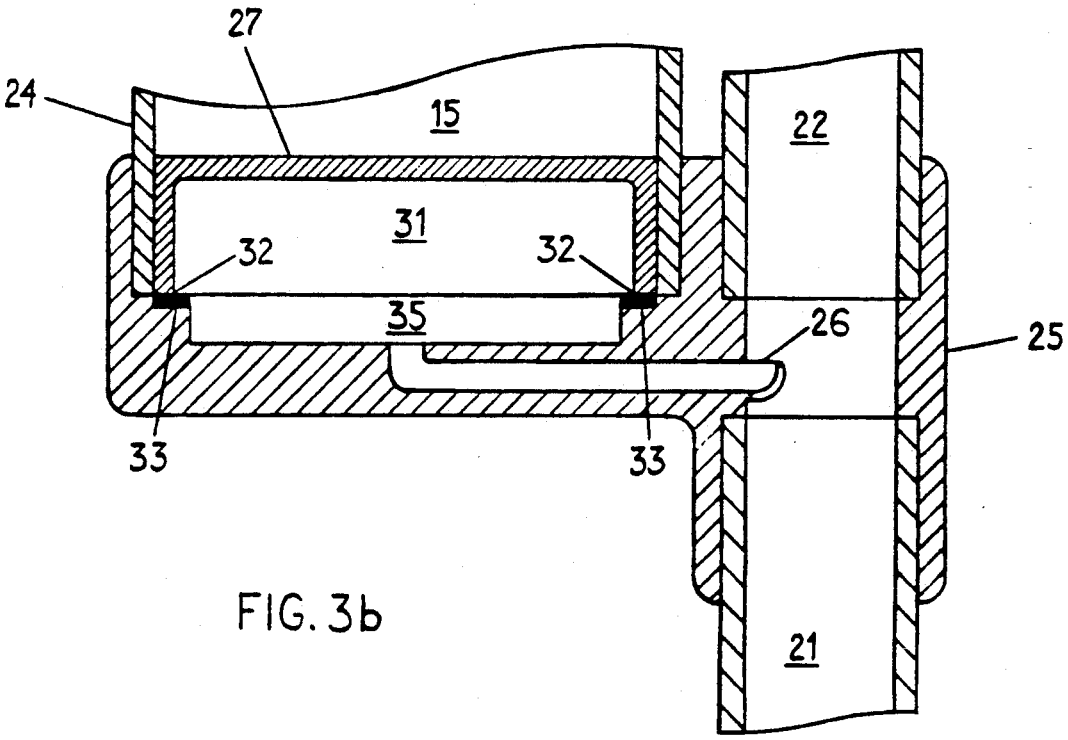

FIGS. 3*a* and 3*b* are a top view and a cross-sectional view of the water pick-up for displacing liquid additives in the dispenser.

Figure 4A:
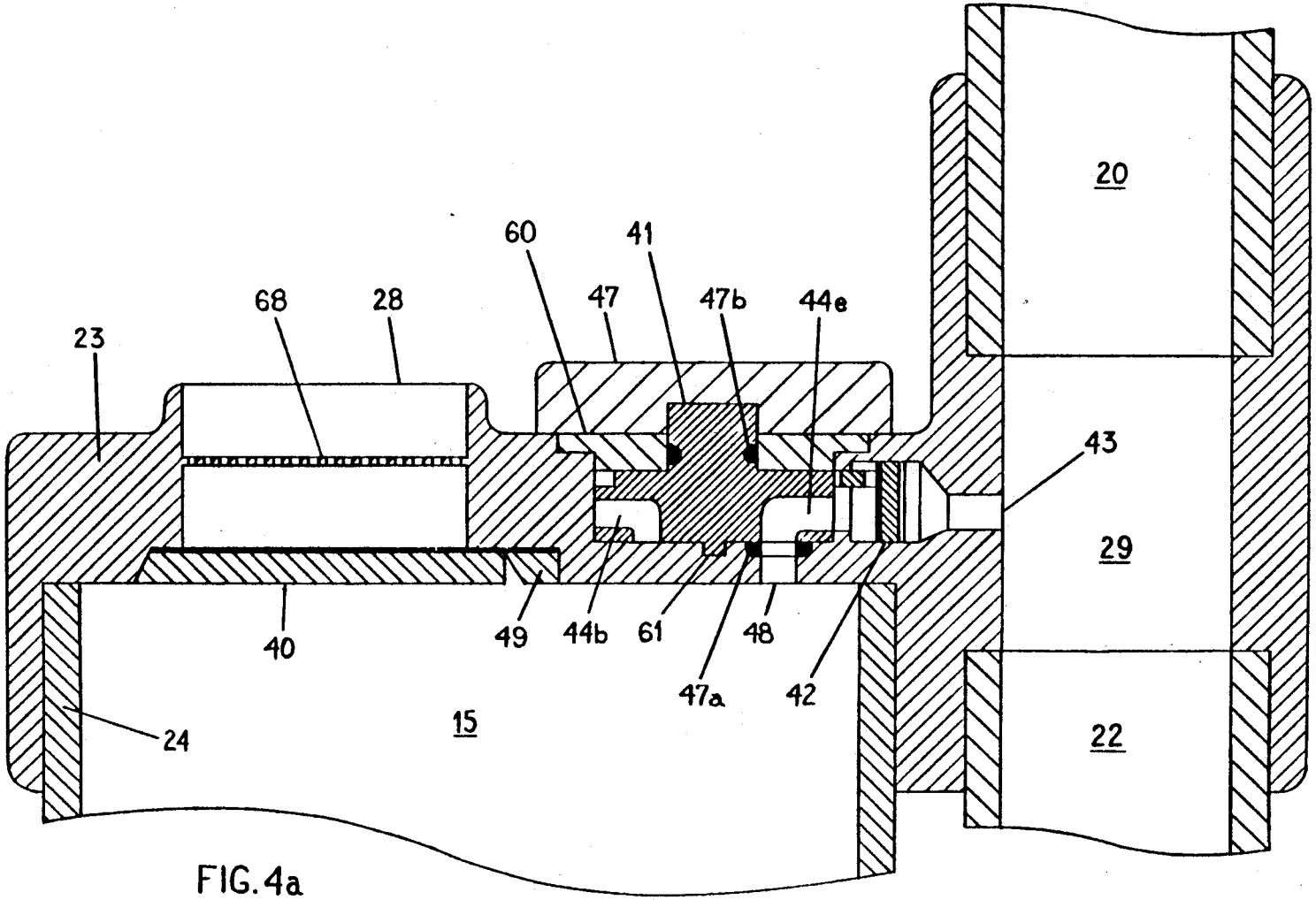
Figure 4C:
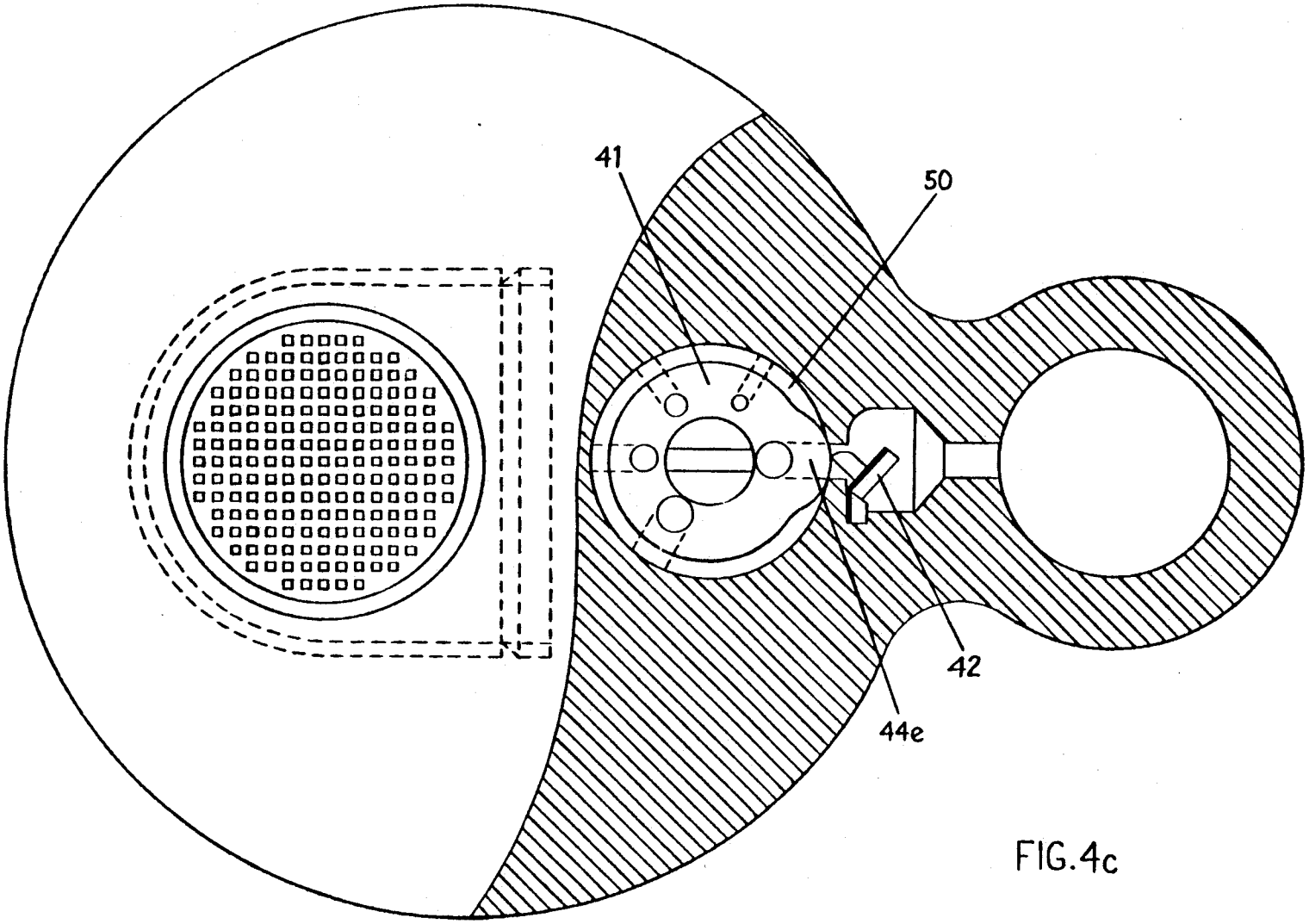

FIGS. 4*a* through 4*c* are schematic illustrations of the additive dispensing control. FIGS. 4*ba* through 4*bc* are cross-sectional views A—A, B—B, and C—C of the rate selector.

Figure 5:
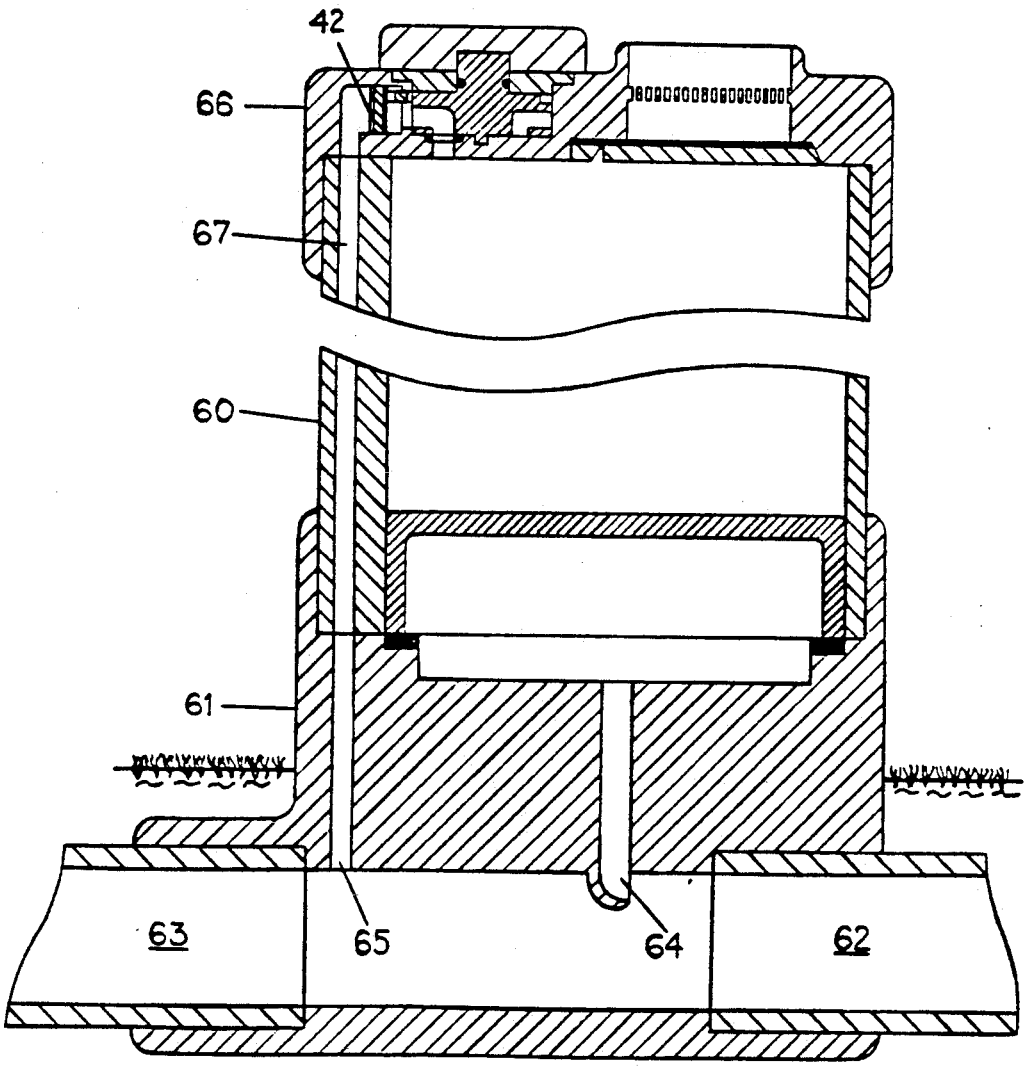

FIG. 5 is an illustration of a dispenser with horizontal input and output ports.

Figure 6:
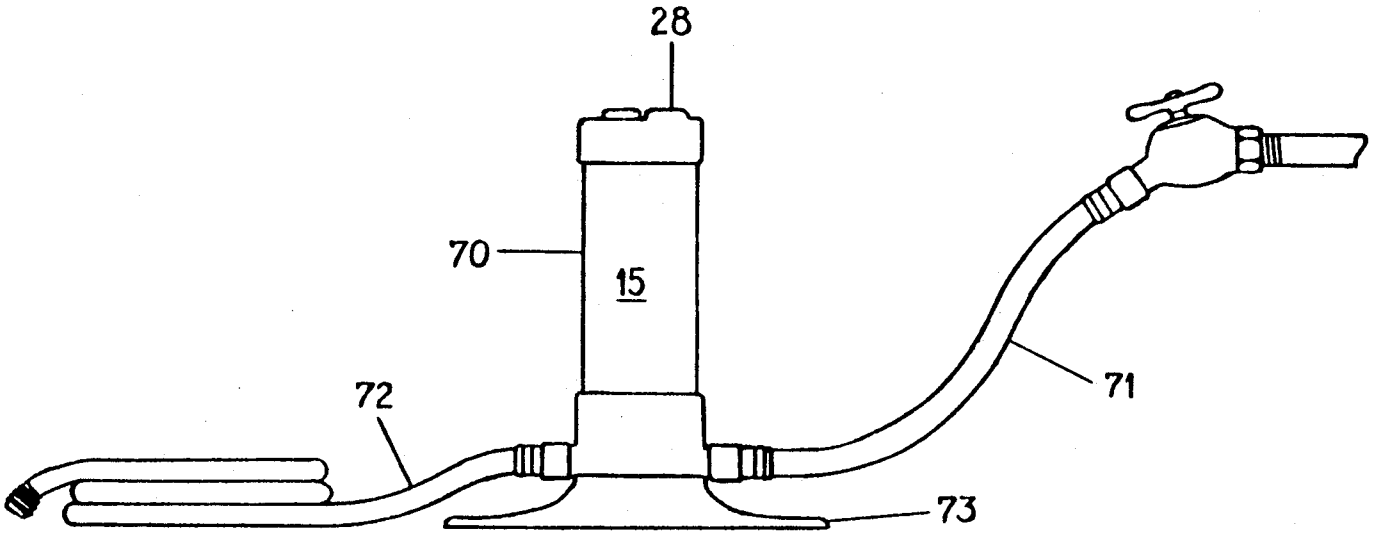

FIG. 6 is an illustration of a portable additive dispenser.

DESCRIPTION OF THE PREFERRED EMBODIMENT

Figure 1:
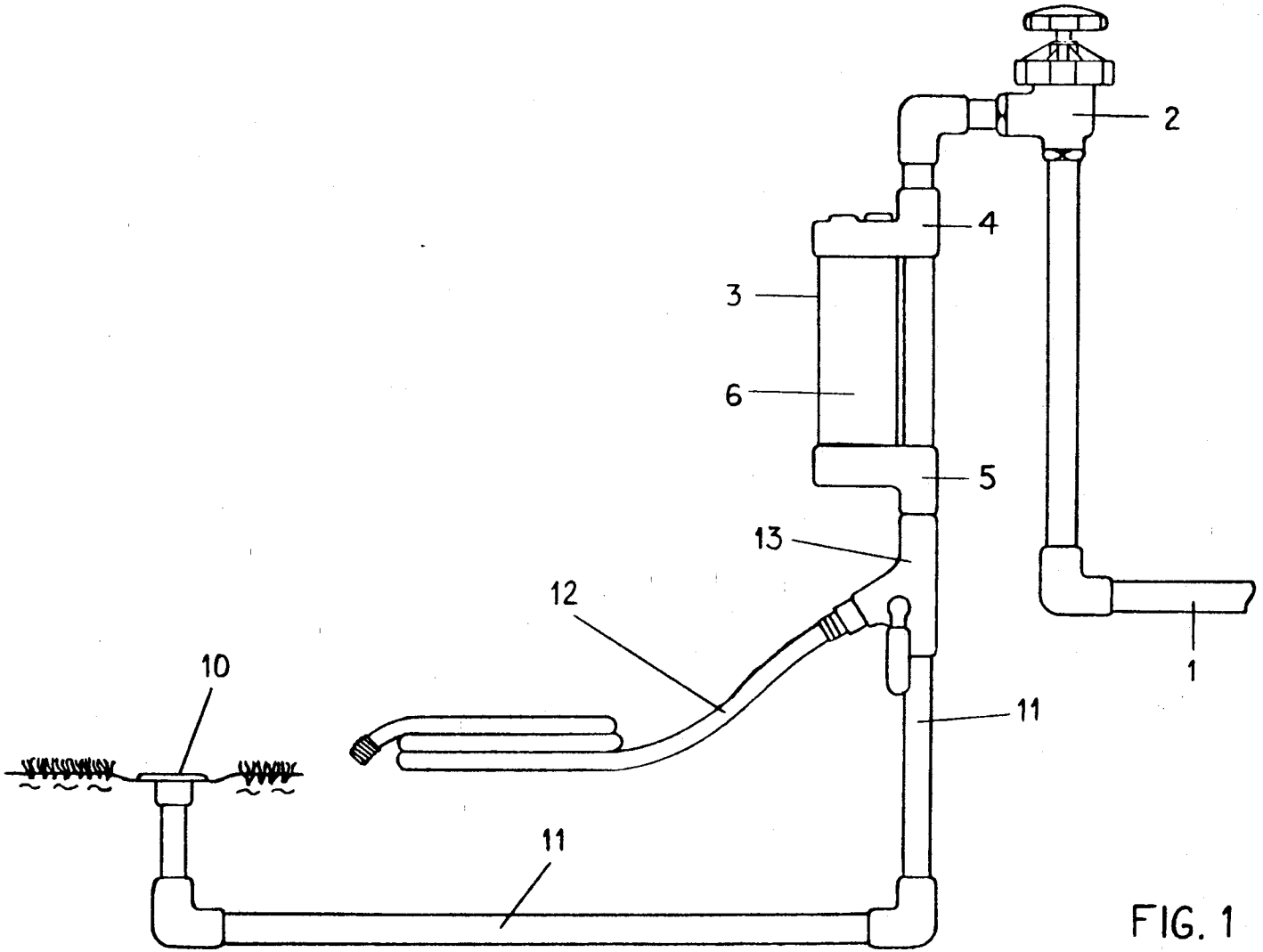
FIG. 1 is a schematic illustration of a sprinkler installation.

In FIG. 1 it is illustrated how the dispenser for liquid additives is interconnected in a garden or lawn sprinkler installation. The sprinkler system receives water from a source through pipe 1. A supply valve 2 enables the user to control the water flow. Valve 2 may be a remote controlled valve for turning water on or off. Valve 2 may include a means to regulate the water flow. In FIG. 1 water supply 1 and valve 2 are shown to be above ground. However, there is no requirement set for this configuration. Dispenser 3 is interconnected in the sprinkler pipe arrangement between valve 2 and the distribution system, e.g. a sprinkler system with sprinklers 10. Dispenser 3 is interconnected vertically and preferably above ground. In FIG. 1 fresh water enters dispenser 3 at intake port 4. Additives are added to the water while it flows from intake port 4 to output port 5. A certain amount of water, the displacement water, is flowing into dispenser cylinder 6 to displace at first air at the start of the operation and then additives during the dispensing operation. At the end of a dispensing operation the displacement water stored in cylinder 6 drains into the pipe system of the sprinkler installation. The sprinkler water leaving dispenser 3 is distributed to the sprinklers such as sprinkler 10 through pipe 11. Since there is no flow restriction in dispenser 3, water can be redirected to a water hose 12, as long as there is a valve by which this water flow can be controlled during operation of the dispenser. In FIG. 1 valve 13 allows to direct water to hose 12 instead of sprinklers 10.

Figure 2:
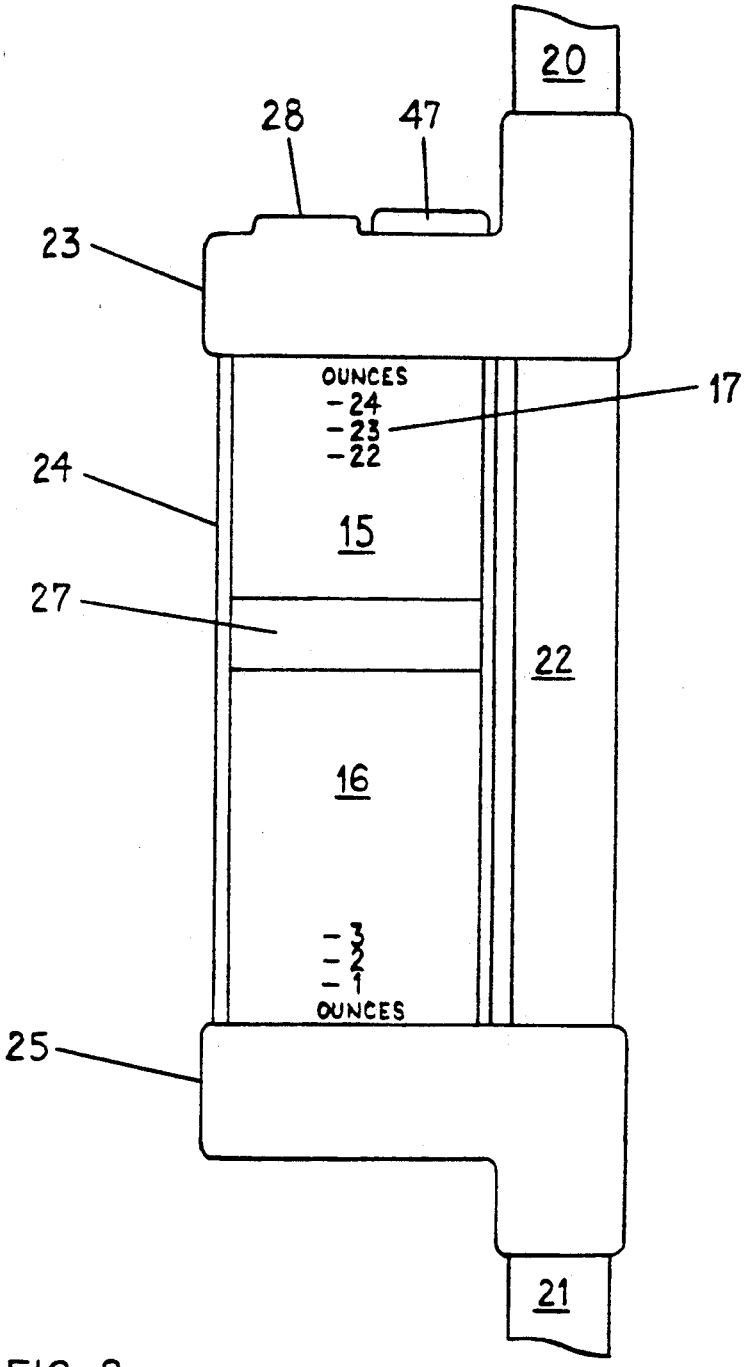
FIG. 2 is an illustration of showing the dispenser.

FIG. 2 is an illustration of dispenser 3 of FIG. 1. The dispenser is connected between supply pipe 20 and sprinkler pipe 21. The dispenser has a water flow through pipe 22 which at the upper end includes a cap section 23 holding the upper end of dispenser cylinder 24 and the mechanism for dispensing additives. The dispensing mechanism is disclosed below with reference to FIG. 4. The lower end of pipe 22 includes base cap 25 holding the lower end of dispenser cylinder 24 and a water scoop which is shown in FIG. 3 for directing displacement water into storage area 16 of dispenser cylinder 24. The additive is stored in storage area 15 and released into the water flow through an orifice in cap section 23 for distribution in the connected sprinkler system.

Dispenser cylinder 24 includes a floating piston 27. When not in operation piston 27 rests at the bottom of cylinder 24. Additives are loaded through additive input 28 as needed into storage area 15. A dial 47 is set to the desired rate of adding the loaded additives to the water flow. As soon as water flows through pipe 22 the water scoop in base cap 25 guides an amount of water proportional to the water flow in pipe 22 into water storage area 16 of dispenser cylinder 24. Piston 27, which has a hollow bottom, floats on top of an air bubble which functions as a seal between additive in storage area 15 and displacement water in storage area 16. Piston 27 lifts the loaded additives. The gap between piston 27 and the inside surface of cylinder 24 is sufficiently small to prevent air from passing from storage area 16 into additive storage area 15.

At start of an operation the air over the loaded additives leaves cylinder 24 through additive input 28. When additive input 28 closes any air still remaining in additive storage area 15 is expelled into the water flow through a passage of the dispensing mechanism in cap 23. The additive is then forced into the dispensing mechanism in cap section 23, from where it enters the water flow to the sprinklers.

Because piston 27 rests at the bottom of cylinder 24 while additives are loaded, graduation 17 is referenced from the top of piston 27 in its lowest position. For reference during operation a second graduation may be provided to indicate the amount of additives remaining in additive storage area 15.

While the use of the additive dispenser of the present invention is disclosed in combination with a sprinkler system, there is no restriction of the use of such a dispenser in combination with a drip system. The dispenser uses the dynamics of water flow to feed displacement water into storage area 16 at a rate substantially proportional to the water flow through pipe 22. This eliminates the need for generating a pressure difference between additive storage area 15 and pipe 22 for dispensing additives into the water flow at the expense of a lower water pressure at sprinklers 10 of FIG. 1 or any other device used in place of sprinklers 10.

FIGS. 3*a* and 3*b* are a top view and a cross-sectional view of the water scoop in cap 25. The dispenser of the present invention uses the rate of water flow as the controlling means for dispensing additives. This is accomplished by having an unrestricted flow of water passing through pipe 22 and having scoop 26 extend into this water flow to redirect a small amount of water through base cap 25 into the bottom of cylinder 24. Piston 27 has a hollow recess 31 and rests with rim 32 on a soft seal 33 in base cap 25. Base cap 25 has a recessed area 35 below piston 27.

When dispenser 3 is not in use, rim 32 of piston 27 rests on soft seal 33 so that any additive still remaining in additive storage area 15 of cylinder 24 can not leak through base cap 25 into the sprinkler piping. When all the displacement water has drained out of water storage area 16 of cylinder 24, the hollow recess 31 in piston 27 and the recessed area 35 in base cap 25 contain air.

When dispenser 3 is in use, displacement water enters hollow recess 31 as a fountain from the center bottom of recessed area 35. The inrushing water is deflected downward from inside piston 27 preventing displacement water from entering additive storage area 15 around rim 32 of piston 27. Because the spacing between rim 32 and the inside wall of cylinder 24 is of close tolerance, none of the air below piston 27 escapes into additive storage area 15. As soon as sufficient water is flowing from scoop 26 into the bottom of cylinder 24, piston 27 starts rising and floats on the air bubble. Piston 27 serves as a separator between the additives in additive storage area 15 in cylinder 24 above piston 27 and the displacing water fed into hollow recess 31 below piston 27.

FIG. 4*a* is a schematic illustration of cap 23 of FIG. 2. Cap 23 includes the dispensing mechanism and flapper valve 40 of additive input 28. Flapper valve 40 functions as an anti-syphon valve by opening under force of gravity as soon as the water pressure is removed. Open flapper valve 40 lets air into additive storage area 15 so that the water can exit from storage area 16. The dispensing mechanism consists of a rotary rate selector 41 for selecting a suitable rate of dispersion, a check valve 42, and output orifice 43. Rotary rate selector 41 provides four additive flow channels 44*a* through 44*d* with different diameters extending at different angles to the outer circumference of rate selector 41 (see FIG. 4*b* and cross-sectional views FIGS. 4*ba* through 4*bc*). Depending upon the position of rate selector 41 one of flow channels 44*a* through 44*d* interconnects the additive storage area 15 of cylinder 24 through opening 48 in cap 23 with check valve 42 and orifice 43. O-rings 47*a* and 47*b* seal the passage for additives from storage area 15 to check valve 42. Rate selector 41 is held in place by retainer 60 and short shaft 61. Check valve 42 prevents water from entering additive storage area 15 above piston 27. Output orifice 43 is a channel interconnecting check valve 42 with water flow through area 29 between pipe 20 and pipe 22 (see FIG. 2) through which the sprinkler water flows toward the sprinklers. The small amount of dynamic pressure derived from the water forced into scoop 26 is sufficient to dispense additives into the water flow through pipe 22. Flapper valve 40 is hinged with stationary section 49 to cap 23 and designed to close under pressure during the start-up phase. Any air remaining in additive storage area 15 after flapper valve 40 closes will be expelled through opening 48. Screen filter 68 at the additive input port 28 prevents debris from entering additive storage area 15. Screen filter 68 is sufficiently fine to prevent particles larger than the smallest of the flow channels 44*a* through 44*d* from entering additive storage area 15, thereby eliminating the need for filters inside dispenser 3.

FIG. 4*c* is an illustration of the operation of rate selector 41. Rate selector 41 includes a control rim 50 for controlling check valve 42. The additive storage area 15 can be rinsed by setting rate selector 41 to flow channel 44*e*, thereby feeding water into additive storage area 15 from supply pipe 20 through check valve 42 and flow channel 44*e*. For this operation control rim 50 keeps check valve 42 open. After selecting the rinse cycle operation by setting selector 41 to flow channel 44*e*, and turning on the water, water flows simultaneously into both the storage areas 15 and 16. During pressurization which causes flapper valve 40 to close, some air escapes out of storage area 15. At the time flapper valve 40 closes the water flow into storage area 15 stops because water is still flowing into storage area 16 which lifts piston 27. Piston 27 expels the remaining air in storage area 15 through opening 48 and its supply pipe 20 and then the rinse water which entered storage area 15. When piston 27 reaches the top in cylinder 24 the rinse cycle is completed and the water can be turned off. The rinse cycle is fully automatic.

FIG. 5 is an illustration of a dispenser with horizontal input and output ports which can be installed directly into a below ground level sprinkler installation supplying water through pipe 62 and delivering water to the sprinklers through pipe 63. Dispenser 60 has a base cap 61 with a water supply pipe 62 and an delivery pipe 63. Cap 61 includes scoop 64 and output orifice 65. Top cap 66 performs the same function as cap 23 in FIGS. 3*a* and 3*b*, except the output of check valve 42 is not directly connected to the water flow, but feeds the additive through a channel 67 to output orifice 65 in base cap 61. Dispenser 60 is directly interconnected at a suitable place in the sprinkler system. To ensure complete and automatic drainage of displacement water from the water storage area the dispenser has to be installed with the bottom of the water storage area above the level of the lowest sprinkler head in the system.

FIG. 6 is an illustration of a portable additive dispenser. Dispenser 70 is similar to the dispenser of FIG. 5, except it is equipped to be connected between a water supply hose 71 and a water distribution hose 72. Furthermore, a foot 73 is attached to the base cap of the dispenser to keep dispenser 70 in the upright position for proper operation.

Dispenser 70 of FIG. 6 can be equipped with an auxiliary reservoir for additives to enlarge the operational usage to large areas. The auxiliary storage would be connected to additive intake port 28. Additive storage 15 would be refilled whenever the water supply is interrupted.

The dispenser of the present invention is described as a device for adding liquid additives to sprinkler water. However, it can be used in many other applications where one liquid is added to another liquid. It can be used with a different rate selector providing different additive ratios and could be equipped with larger or smaller flow channels for adaptation to other liquids, all without departing from the spirit of the invention. Instead of using the dispenser of the present invention in gardening applications it can be used for adding liquid additives into other liquids.

What I claim is:

1. A water flow controlled apparatus for dispensing liquid additives into a water flow comprising a water flow through pipe;

a cylinder including a first storage area for storing said liquid additives, a second storage area for receiving displacement water, and a piston separating said first storage area from said second storage area; access means for filling additives into said first storage area;

a water scoop protruding into said pipe for directing an amount of said water flow proportional to said water flow entering said pipe into said second storage area thereby filling said second storage area with said displacement water;

dispensing means interconnecting said first storage area with said pipe downstream to said water scoop for dispensing said liquid additives stored in said first storage area into said flow of water and including selection means for selecting one of a plurality of selectable rates for releasing said additives into said water stream;

said dispensing means including a controlled check valve said controlled check valve preventing water from flowing from said water flow through pipe into said first storage area when said selecting means is set to a release rate, said selecting means further includes a position for rinsing said first storage area and wherein said controlled check valve remains open when said selecting means is set to said position for rinsing said first storage area.

2. A water flow controlled apparatus for dispensing liquid additives into a water flow comprising a water flow through pipe;

a cylinder including a first storage area for storing said liquid additives, a second storage area for receiving displacement water, and a piston separating said first storage area from said second storage area;

access means for filling said additives into said first storage area;

a water scoop protruding into said pipe for directing an amount of said water flow proportional to said water flow entering said pipe into said second storage area thereby filling said second storage area with said displacement water; dispensing means interconnecting said first storage area with said pipe downstream from said water scoop for dispensing said liquid additives stored in said first storage area into said flow of water, and including selection means for selecting one of a plurality of selectable rates for releasing said additives into said water flow, wherein said water flow is provided by a water supply at a pressure for sustaining said water flow, said access means is adapted to close if said first storage area is pressurized by said water pressure, and to open when said first storage area is not pressurized, thereby allowing said displacement water to flow out of said second storage area, to ventilate said water flow through pipe through said dispensing means, thereby performing an antisyphon function.

3. A water flow controlled apparatus for dispensing liquid additives into a water flow comprising a water flow pipe;

a cylinder including a first storage area for storing said liquid additives, a second storage area for receiving displacement water, and a piston separating said first storage area from said second storage area;

said piston including a hollow space having a rim for trapping air, a seal at the bottom of said second storage area, said rim resting on said seal for preventing leakage of additives from said first storage area into said second storage area when said dispenser is not in operation;

access means for filling said additives into said first storage area;

a water scoop protruding into said pipe for directing an amount of said water flow proportional to said water flow entering said pipe into said second storage area thereby filling said second storage area with displacement water;

dispensing means interconnecting said first storage area with said pipe downstream from said water scoop for dispensing said liquid additives stored in said first storage area into said flow of water, and including means for selecting one of a plurality of selectable rates for releasing said additives into said water flow, whereby said additives are released into said water flow at the selected rate.

4. An apparatus for dispensing liquid additives into a water flow as claimed in claim 3, wherein the outside of said piston and the inside of said cylinder are sufficiently close to prevent air from leaking from said second storage area to said first storage area, said air trapped in the hollow space of said piston constituting a first amount of air;

said second storage area further including a recessed space at the bottom and inside said seal, said recessed space providing a second amount of air, said first and second amounts of air providing for an air seal underneath said piston and reaching the inside surface of said cylinder while said piston floats between said first storage area and said second storage area.

* * * * *